US005658158A

United States Patent [19]

Milan

[11] Patent Number: 5,658,158

[45] Date of Patent: Aug. 19, 1997

[54] MODULAR SURGE PROTECTION SYSTEM WITH INTERCHANGEABLE SURGE PROTECTION MODULES

[76] Inventor: Henry Milan, 1709 Appleridge Ct., Rochester Hills, Mich. 48309

[21] Appl. No.: 519,788

[22] Filed: Aug. 28, 1995

[51] Int. Cl.[6] ..... H01R 25/16

[52] U.S. Cl. ..... 439/214; 439/620; 439/76.1; 439/639; 439/652

[58] Field of Search ..... 439/214, 210, 439/211, 652, 207, 209, 216, 622, 620, 651, 76.1; 200/51.11

[56] References Cited

U.S. PATENT DOCUMENTS

| | | | |
|---|---|---|---|
| 1,990,176 | 2/1935 | Fried | 439/622 |
| 2,269,779 | 1/1942 | Morten | 439/216 |
| 2,307,230 | 1/1943 | Morten | 439/214 |
| 2,320,332 | 5/1943 | Morten | 439/209 |
| 2,453,314 | 11/1948 | Hammerly | 439/211 |
| 2,457,831 | 1/1949 | O'Brien | 439/214 |
| 2,640,125 | 5/1953 | Eggers | 439/622 |
| 2,952,829 | 9/1960 | Grohsgal | 439/214 |
| 4,085,996 | 4/1978 | Koslo | 439/652 |
| 4,641,900 | 2/1987 | Japngie | 439/651 |
| 4,659,161 | 4/1987 | Holcomb | 439/652 |
| 4,867,701 | 9/1989 | Wiand | 439/652 |
| 4,875,871 | 10/1989 | Booty, Sr. et al. | 439/210 |
| 4,909,749 | 3/1990 | Long | 439/346 |
| 4,954,098 | 9/1990 | Hollingsworth et al. | 439/350 |
| 4,955,815 | 9/1990 | Gate et al. | 439/350 |
| 5,071,367 | 12/1991 | Luu | 439/502 |
| 5,292,257 | 3/1994 | Milan | 439/620 |
| 5,334,033 | 8/1994 | Milan | 439/620 |

FOREIGN PATENT DOCUMENTS

| | | | |
|---|---|---|---|
| 914712 | 10/1946 | France | 439/209 |
| 186929 | 1/1992 | Taiwan . | |
| 591432 | 8/1947 | United Kingdom | 439/209 |
| 591664 | 8/1947 | United Kingdom | 439/209 |
| 2012497 | 7/1979 | United Kingdom | 439/207 |

*Primary Examiner*—Gary F. Paumen
*Attorney, Agent, or Firm*—Marshall & Melhorn

[57] ABSTRACT

A modular surge protection system is provided having interchangeable power supply and surge protection modules connectable to a power distribution module the power distribution module provides surge protection for the power supply modules while independent surge protection is provided in the surge protection modules.

15 Claims, 5 Drawing Sheets

MODULAR SURGE PROTECTION SYSTEM WITH INTERCHANGEABLE SURGE PROTECTION MODULES

FIELD OF THE INVENTION

The present invention relates to surge protection systems of a modular nature, whereby surge protection may be provided for various types of electrical devices and/or connections, such as power supply line cords, incoming telephone lines, cable TV protection using coaxial connections, local area networks (LAN's) and wide area networks (WAN's).

More particularly, the invention deals with a surge protection system having several types of modules which are quickly and easily connected and disconnected in any desired order by virtue of quick connect means provided on the modules.

Most particularly, the invention deals with a modular surge protection system of the foregoing nature wherein surge protection modules which provide surge protection to ground may be interchangeable with surge protection modules having surge protection between hot or live and neutral.

DESCRIPTION OF THE PRIOR ART

Sophisticated electrically operated equipment is particularly sensitive to surges of current over the power supply lines to which it is connected, as well as surges of current occurring in lines connecting it to other electrical equipment with which it communicates. These current surges can be caused by naturally occurring phenomenon, such as lightening strikes during thunder storms, which induce power surges in the power lines, or by man made causes, such as sudden variations in the power being output from a generating station due to the failures of components or other generators going on or off line. Electrical equipment which is particularly sensitive to surges in the power supply lines are television sets, stereos, answering machines, computer equipment, etc. Equipment which is particularly sensitive to surges in the lines connecting it to other equipment are telephone lines, computer equipment, coaxial cable and local area network lines and the like.

While surge protection for power supply lines is widely known in the art, surge protection for telephone equipment and computer equipment utilizing telephone lines and local area networks, as well as surge protection for coaxial cable to prevent television equipment from being damaged due to lightening induced surges in the antenna line, are only more recently known.

Surge protection systems for this type of equipment are generally of two types. One such type is shown in my U.S. Pat. Nos. 5,292,257 and 5,334,033, the specifications of which are specifically incorporated herein in their entirety, by reference. These patents show a modem surge protection as part of a module having power supply outlets. The module having modem surge protection is only attachable at the end of the power distribution module or other modules attached to the power distribution module. This has sometimes proven inconvenient to the user who needs to have surge protection for various other types of equipment as near as possible to the power outlet, but also needs a number of power supply outlets.

Another type of surge protection is known in the Max Allpath 6 device made by Panamax of San Rafael, Calif. This device has surge protection modules which snap onto the end of a power supply platform. These modules have no power supply outlets, and can only go on the end of the power supply platform. This produces another type of inconvenience when additional power supply outlets must be provided, since there is no way to do this. Thus, those skilled in the art continued to seek a solution to the problem of how to provide a more flexible surge protection system.

SUMMARY OF THE INVENTION

In order to solve the above-described problems of long standing in the art, a surge protection system, and modules therefore, are provided which are completely interchangeable. A surge protection module of any desired type may be inserted as the first module in the system after a power distribution module, the last module in the system, or anywhere in between. Several types of surge protector connections may be provided on one module, or individual modules each with a different type of surge protector connection may be provided.

Generally the surge protection system consists of a power distribution module which is connected to a source of line current, one or more modules of a power supply type which snap to each other and/or to the power distribution module, and one or more modules solely of a surge protection type, which may snap to any of the other modules. This provides the needed functions without at the same time providing a large and bulky surge protector.

Surge protection for power supply modules is provided in the power distribution module in the form of a capacitor connected across the hot or live and earth or neutral connectors, which are in turn electrically connected to source of line current.

The surge protection for the various surge protection connectors, such as incoming telephone lines using a RJ11 connector, or local area network protection using a RJ45 connector, is provided separately in the surge protection modules independently of the power distribution module, and consists of one or more capacitors electrically connected between the connector and ground.

Since the surge protection for the power supply receptacles in the power distribution module is independent of the surge protection for the various connecting means requiring "ground" surge protection, complete interchangeability is provided for. By providing a male portion of a quick connect means on one end of each surge protection module, and a female portion on the other end of each surge protection module, together with a direct pass through for the hot or live and earth or neutral connections, a completely interchangeable module is provided.

In one modification of the present invention, a power distribution module having surge protection has a line cord having a standard and well known three prong plug for connection to a source of line current. Connected to the line cord seriatim may be such as a circuit breaker, an on-off switch, an indicator light and a power transfer receptacle. A female portion of a quick connect means is also provided by which a power supply or a surge protection module having at least one male power transfer connector and a male portion of a quick connect means may be quickly snapped into place. The power supply modules may have as few as one power supply receptacle, or may have as many as desired. One or more surge protection modules having "ground" surge protection, may be interposed anywhere desired into the surge protection system.

In another modification of the present invention an interchangeable surge protection module is provided. The surge protection module has a female portion of a quick connect means on one end thereof, and a male portion of a quick connect means on the other end thereof. Appropriate female and male power transfer connectors are provided, as well as a ground connection so that live, and/or earth and/or ground received from another module may pass completely through the surge protection module and be supplied to the next module in line. A RJ11, RJ45, RS232, or a co-ax connector is provided on the module and connected to ground through an appropriate capacitor.

In a third modification, one or more surge protection modules only are connected to a power distribution module by the quick connect means. Only the neutral connection of the power distribution module is used since the live and earth connections are not needed if no power is to be transferred to a power supply module.

Thus, it is an object of the present invention to provide a modular surge protection system.

It is a further object of the present invention to provide a modular surge protection system having a power distribution module and/or one or more types of power supply modules and/or surge protection modules.

A still further object of the present invention is to provide a power distribution module having live/earth surge protection for use in a modular surge protection system. The module has a line cord connected seriatim to a source of power, a circuit breaker, an indicator light and a switch, and terminating in a power transfer means co-operating with the female portion of a quick connect means.

It is a further object of the present invention to provide a surge protection module having "ground" surge protection for use in a modular surge protection system having one, or a plurality of, connecting means provided thereon, a male portion of a quick connect means formed on one end thereof, and a female portion of a quick connect means formed on the other end thereof.

A still further object of the present invention is to provide a modular surge protector system of the foregoing nature which is easy to manufacture and is of a low cost and economical nature.

Further objects and advantages of the present invention will be apparent from the following description and appended claims, reference being made to the accompanying drawings forming a part of the specification, wherein like reference characters designate corresponding parts in the several views.

It is to be understood that the present invention is not limited to the details of construction and arrangement of parts illustrated in the accompanying drawings, since the invention is capable of other embodiments, and is capable of being practiced or carried out in various ways within the scope of the claims. Also, it is to be understood, that the phraseology and terminology employed herein is for the purpose of description, and not of limitation.

DETAILED DESCRIPTION OF THE PREFERRED EMBODIMENT

Figure 1:
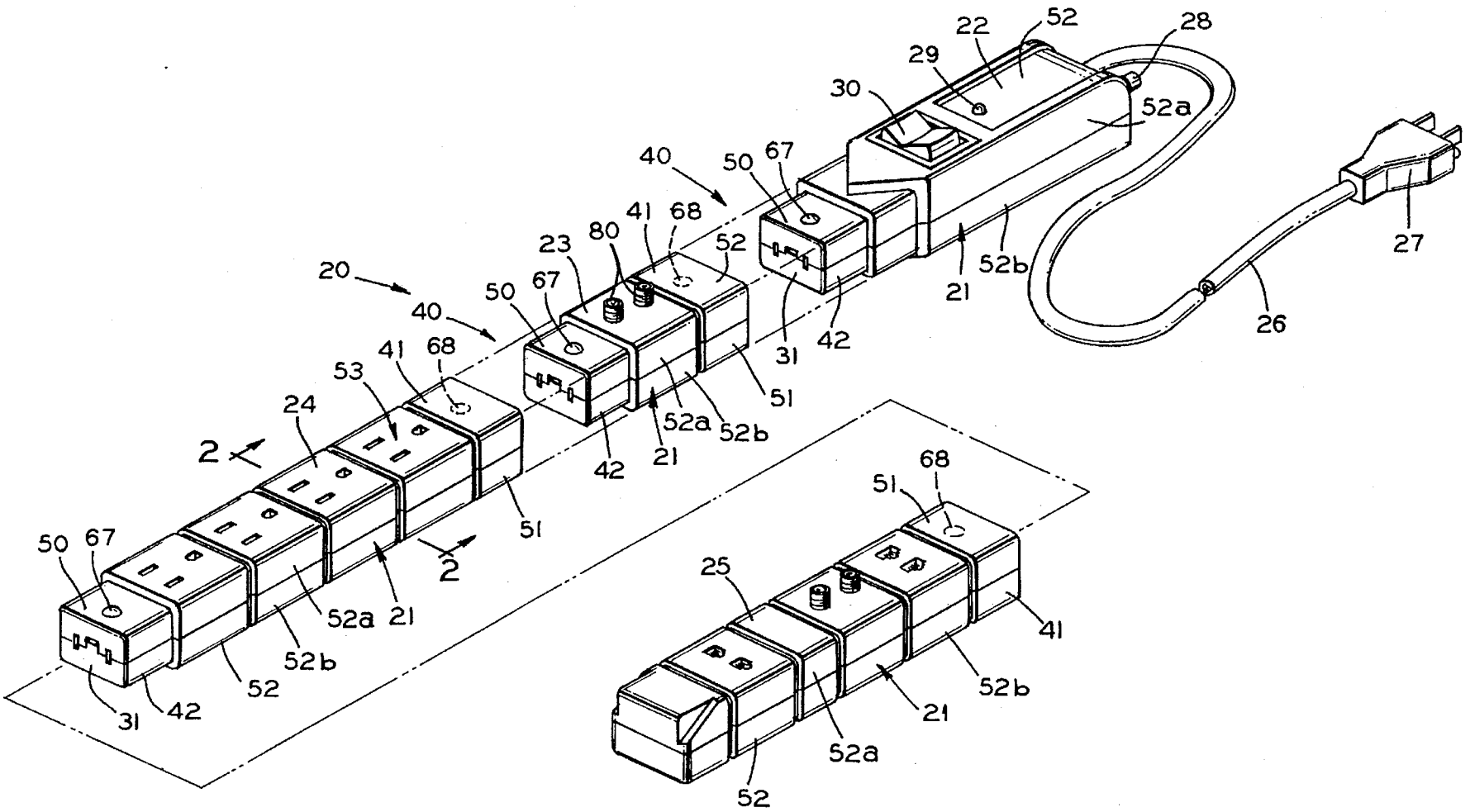
FIG. 1 is a perspective view of a modular surge protection system embodying the present invention, showing some of the different modules usable with the system of the present invention, and how they connect together.

Referring now to FIG. 1, there is shown an exploded perspective view of the modular surge protection system of the present invention, generally designated by the numeral 20. This modular surge protection system is similar in some respects to the modular outlet strips shown in my U.S. Pat. Nos. 5,292,257 and 5,334,033, the specification of which have been specifically incorporated by reference, but represent distinct improvements thereover, as will be explained below. The modular surge protection system 20 may include one or more modules 21 such as the power distribution module 22, the co-ax surge protection module 23, the four receptacle power supply module 24, and the combination modem, LAN, and co-ax surge protection module 25.

The power distribution module 22 typically has a line cord 26 terminating in a plug 27 for connection to a source of line current. The plug 27 may be a two prong or a three prong plug or other plug as desired. For purposes of illustration there is a shown a standard three conductor polarized connector or grounding plug, although it is to be understood that whatever type of line current the surge protector is to be used on will dictate the particular form of plug.

Also it can be understood by those skilled in the art that the power distribution module 22 itself could have an appropriate set of male live, neutral, and ground connectors to be plugged directly into a wall outlet.

Also found on the power distribution module 22 may be a circuit breaker 28 an indicator light 29 and an on/off switch 30. The line cord 26 is electrically connected seriatim to the circuit breaker 28, the indicator light 29, and the on/off switch 30 before terminating at the female power transfer connector or receptacle 31. Power supply surge protection in the form of a suitable capacitor or other device connected across hot or live and neutral is provided in the power distribution module 22 for use by the power supply modules. It can be understood by those skilled in the art that the arrangement of these parts may vary, and the combination thereof may also vary and still be within the scope of the present invention.

Figure 6:
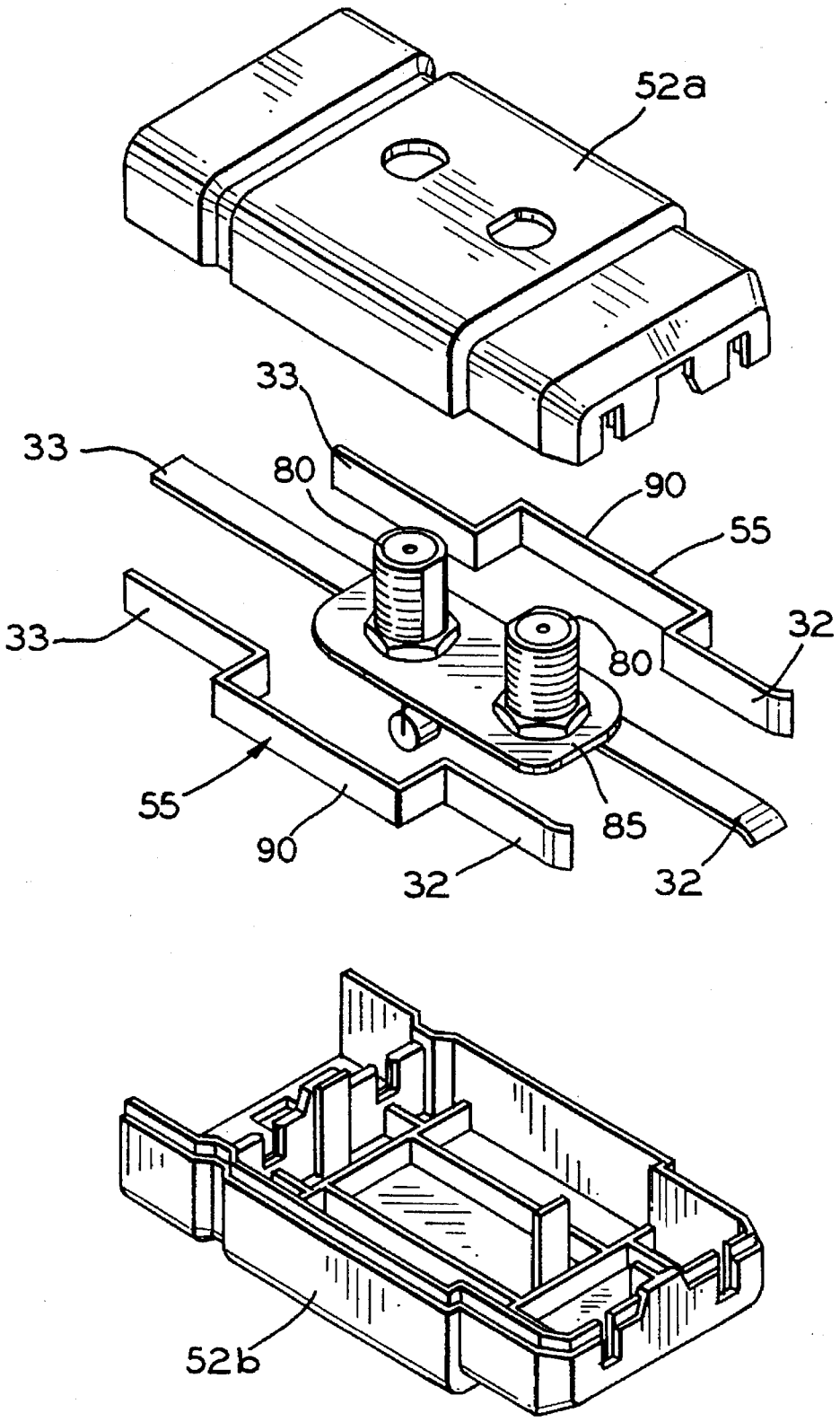
FIG. 6 is an exploded perspective view of the co-ax module shown in FIG. 1.
Figure 7:
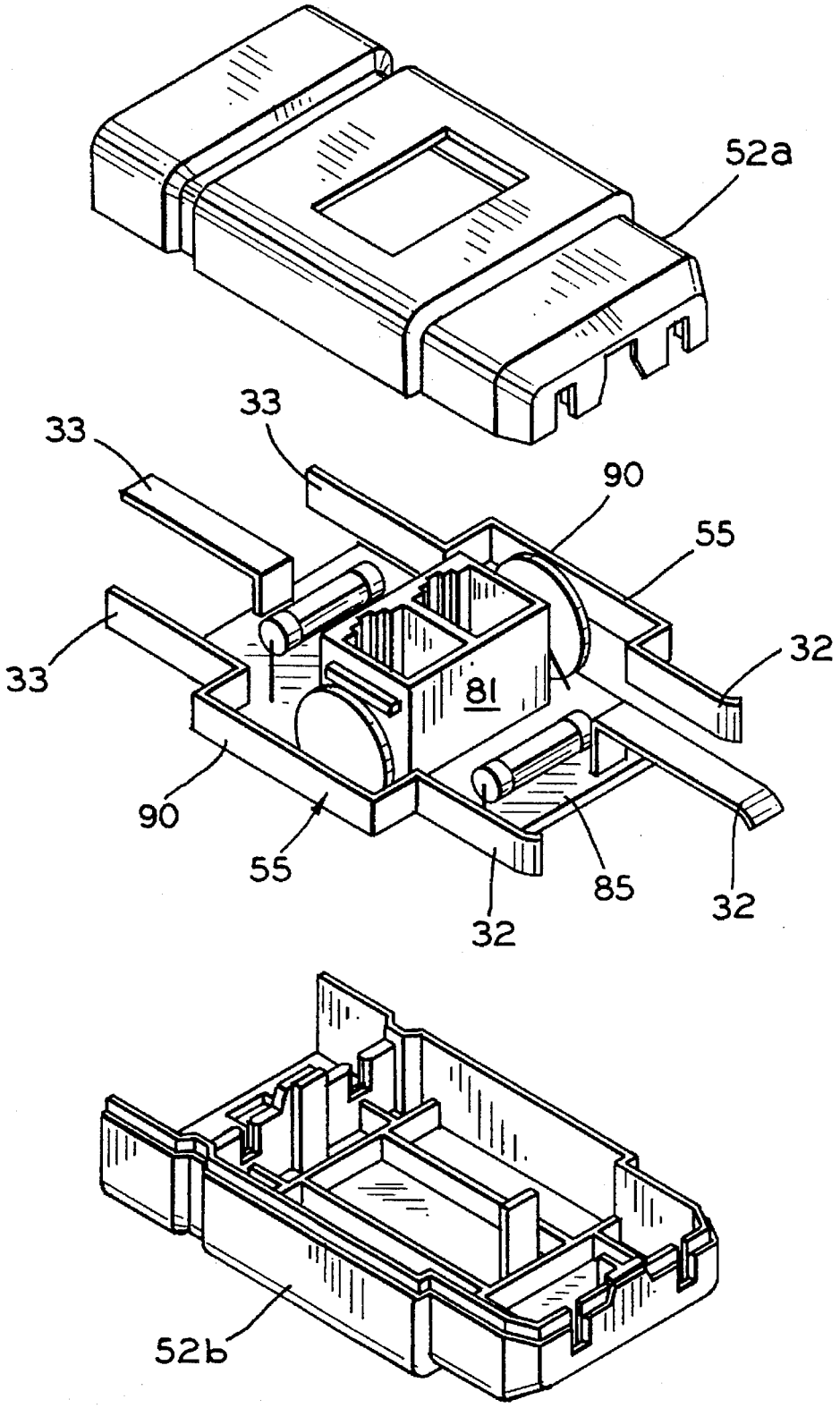
FIG. 7 is an exploded perspective view of a surge protection module having an RJ11 adapter.
Figure 8:
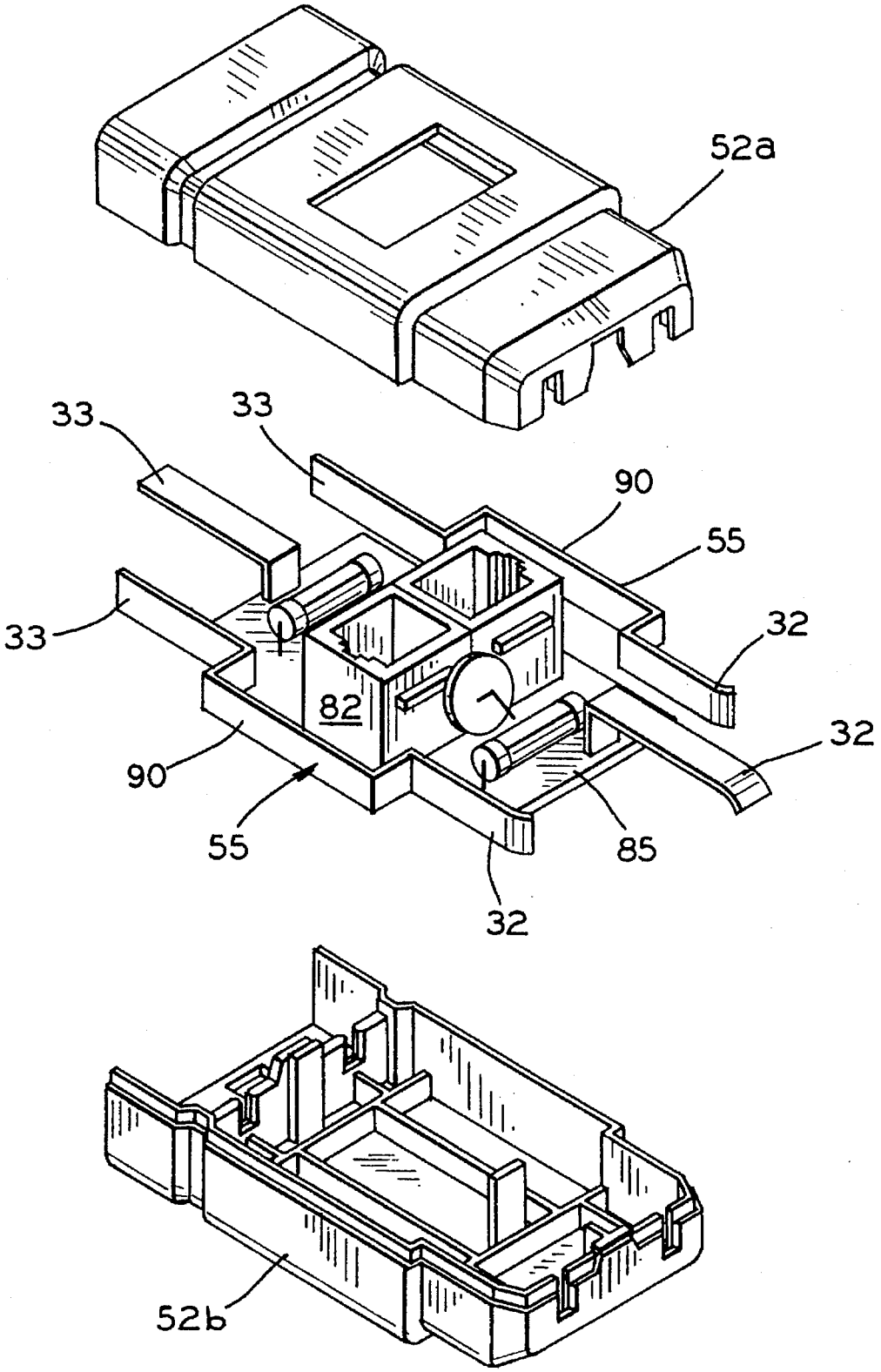
FIG. 8 is an exploded perspective view of a surge protection module having an RJ45 adapter.

The interior construction of the various modules 21 of the modular surge protection system 20 may be identical to that described in my U.S. Pat. Nos. 5,292,257 and 5,334,033 and need not be described in further detail herein. Also it will be obvious to those skilled in the art that other interior constructions may be used, such as shown in FIGS. 6–8, and be well within the scope of the present invention.

Also, it will be understood from the foregoing description of the present invention that the type, arrangement, and positioning, of the male and female portions of the quick connect means to be described hereinafter may also vary and be well within the scope of the present invention. Any of the variations shown in my said aforementioned U.S. Letters Patents, or any other practical quick connect means, may be used and be well within the scope of the present invention.

The various modules 21 of my improved surge protection system are connected by quick connect means, generally designated by the numeral 40. Each of the quick connect means 40 contains a male portion 41 and a female portion 42. To protect the electrical connectors to be described hereinafter, a shroud 51 is provided on the male portion 41 of the quick connect means 40. A reduced housing portion 50 is provided on the female portion 42 of the quick connect means 40. The shroud 51 completely encloses and covers the reduced housing portion 50 when a pair of modules 21 is "snapped" together.

To provide additional stability to the connection between the various modules, the various retainer means and retaining means described in the aforementioned United States Letters Patents can be used. In the preferred embodiment of the invention described herein, there is provided on the top of the reduced housing portion 50 the dome 67 adapted to fit into the circular recess 68 provided in the shroud 51.

Figure 2:
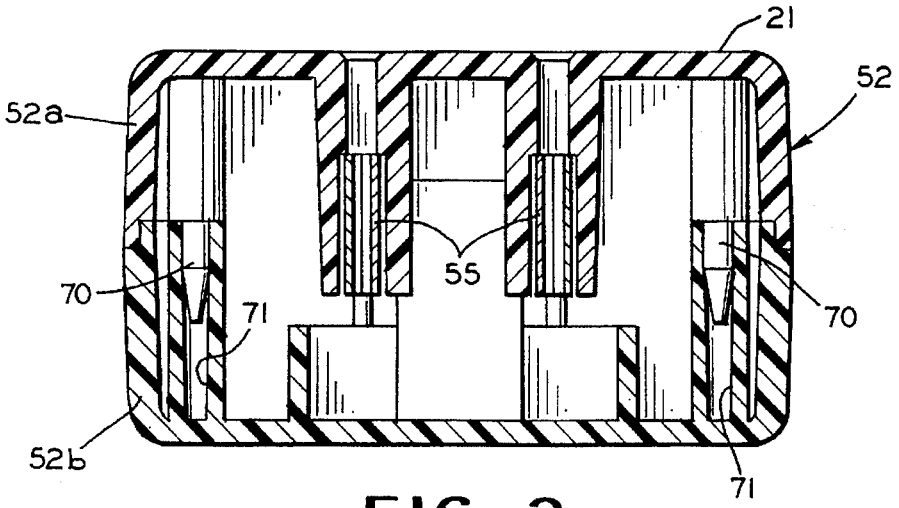
FIG. 2 is a sectional view, taken in the direction of the arrows, along the section line 2—2 of FIG. 1.

Referring to FIG. 2 it can be seen that each module 21 is provided with an upper housing portion **52*a* and a lower housing portion 52*b* which snap together to form housing 52. A plurality of posts 70 are provided which fit into mating post holes 71. The live, neutral and ground connector strips 55 can be seen to be contained within the housing 52**.

Figure 3:
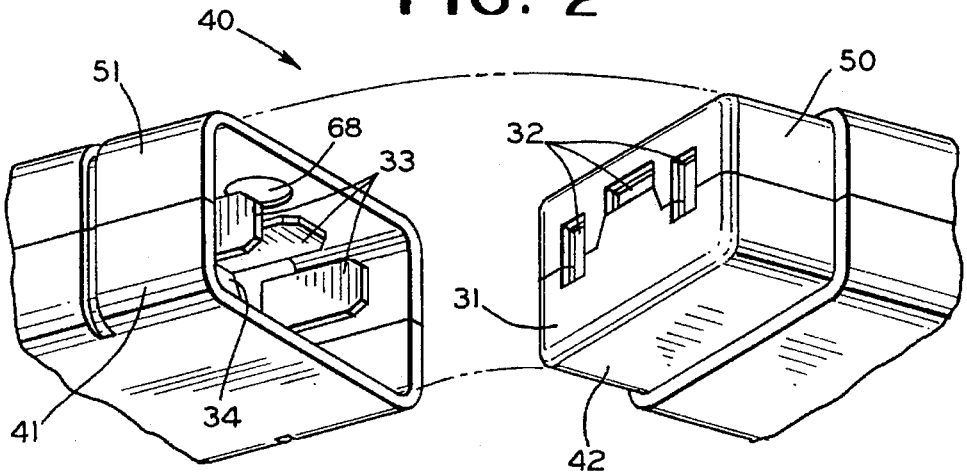
FIG. 3 is an enlarged view of the quick connect means shown in FIG. 1.
Figure 4:
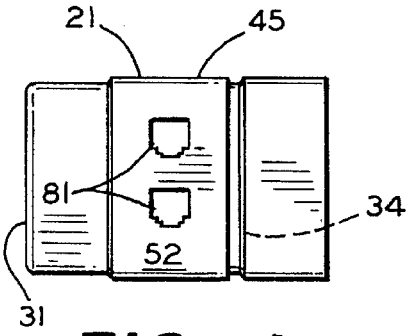
FIG. 4 is a top plan view of a surge protection module for modem and fax machine protection having an RJ11 adapter.
Figure 5:
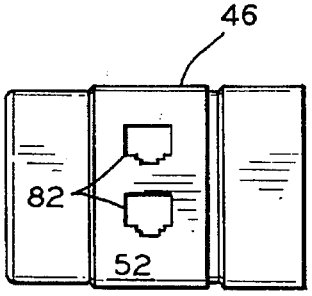
FIG. 5 is a top plan view of a surge protection module for a LAN having an RJ45 adapter.

Referring now to FIG. 3 the live, neutral and ground female receptors 32 in each female power transfer connector 31 (not shown but which may be the same as disclosed in U.S. Pat. Nos. 5,292,257 and 5,334,033) are connectable to the live, neutral and ground male connectors 33 in the male power transfer power connector 34 (not shown) by the live neutral and ground connector strips 55 shown in FIG. 2. These are of a type well known in the art and need not be described in detail herein.

Figure 9:
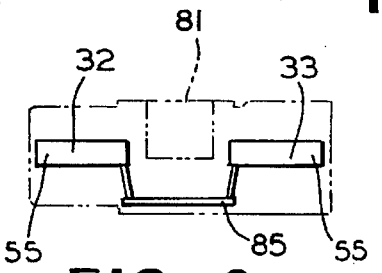
FIG. 9 is an elevation view, partly in phantom, showing a modification of the surge protection module.

Referring to FIGS. 6–8, the electrical connecting means which is being grounded, which may be such as the co-ax connector 80, the RJ11 connector 81, or the RJ45 connector 82, shown in FIGS. 6–8, would be electrically connected to the printed circuit board 85 in a manner well known in the art. The printed circuit board 85 would be connected to the ground male connector 33 of the male power transfer connector 34, and to the female power transfer receptor 32 of the female power transfer connector 31 to provide the source of ground needed by the various devices 80–82 being grounded. Since in this modification of the invention only the "ground" surge protection is needed, the live and neutral connector strips 55 are of an unique construction and completely hi-pass the printed circuit board 85. Each end of the live and neutral connector strips 55 will have the appropriate male connector 33 and female receptor 32 formed thereon. But the mid portion of the connector strip will have an expanded portion 90 which will travel proximate the outside wall of the housing 52 to avoid any contact with the printed circuit board 85 or the various components mounted thereon. Thus, the live and neutral connector strips 55 form a completely pass through function in this embodiment of the invention. However, it can be understood, that, if desired, the live and neutral connector strips 55 could utilize the circuit board 85 to make an electrical connection between the connector portions 33 and the receptor portions 32, if desired. An example of this construction is shown in FIG. 9, and is well within the scope of the present invention.

While the electrical connections described in connection with FIG. 8 would be typical, since only a source of ground is needed, only the ground contact strip 55 and the ground male connectors 33 in the male power transfer connecter 34 (not shown) need be electrically conductive. The live and neutral connectors (32,33) may be dummy contacts or not electrically conductive contacts. This version of the surge protection modules would be used if the surge protection system of the present invention were to be assembled such that a power distribution module and surge protection modules were to be used, and no power supply modules were to be used.

In essence then my improved surge protection system has several distinct types of modules. The first of these is a power distribution module 22, either plugable directly into a wall outlet, or plugable into wall outlet by use of a line cord and plug.

The second type of module may be referred to as a "ground" only surge protection module because there is no surge protection provided between live and neutral. It may or may not pass the live and neutral power through the module for subsequent use.

The third type of module is the "power supply" module, such as the four outlet module 24, which utilize the live to neutral ground found in the power distribution module 22 to protect equipment connected thereto.

The last type of module 21 provided in this system is the combination module 25. This may be of the ground only type as illustrated in FIG. 1 when it is intended to be placed on the very end of a plurality of modules 21 and not be interchangeable. In this instance the RJ11 connector 81, the co-ax connectors 80 and RJ45 connectors 82 would only be connected to ground. However it can be understood that an interchangeable combination module could be provided where a power pass through for live and neutral is provided in the combination module 25 just as it was for the interchangeable surge protection modules 23,45,46 previously described.

Thus, by carefully analyzing the problems found in the prior art, I have developed a novel and unique surge protection system.

What is claimed is:

1. An interchangeable surge protection module for use in a modular surge protector system including, in combination:

a) a housing, said housing including a male portion of a quick connect means formed at one end thereof, and a female portion of a quick connect means formed at the other end of said housing;

b) a printed circuit board mounted within said housing;

c) a connecting means to connect a device or line being protected to ground, said connecting means mounted to said printed circuit board;

d) a female power transfer receptacle having at least a female ground receptor provided adjacent said female portion of said quick connect means, said female ground receptor mounted to said printed circuit board and electrically connected to said connecting means; and e) a male power transfer connector having at least a male ground connector provided adjacent said male portion of said quick connect means, said male ground connector mounted to said printed circuit board and electrically connected to said connecting means.

2. The module defined in claim 1, wherein;

a) said female power transfer receptacle includes live and neutral receptors formed adjacent said female portion of said quick connect means; and b) said male power transfer receptacle includes live, neutral and ground male connectors formed adjacent said male portion of said quick connect means.

3. The module defined in claim 2, wherein said male portion of said quick connect means includes a shroud completely encircling said live, neutral, and ground male connectors.

4. The module defined in claim 3, wherein said female portion of said quick connect means includes a reduced housing portion surrounding said live, neutral and ground receptors.

5. The module defined in claim 4, wherein said connecting means is a co-ax connecting means.

6. The module defined in claim 4, wherein said connecting means is a RJ11 adapter.

7. The module defined in claim 4, wherein said connecting means is a RJ45 adapter.

8. The module defined in claim 2, wherein said live receptor and said live male connector are formed in a unitary connector strip, said connector strip having an expanded portion.

9. The module defined in claim 8, wherein said neutral receptor and said neutral male connector are formed in a unitary connector strip, said connector strip having an expanded portion.

10. The module defined in claim 9, wherein said live unitary connector strip and said neutral unitary connector strip are formed of electrically non-conductive material.

11. The module defined in claim 12, wherein said live receptor and said live male connector are separate and distinct and are electrically connected through said printed circuit board.

12. The module defined in claim 11, wherein said neutral receptor and said neutral male connector are separate and distinct and are electrically connected through said printed circuit board.

13. A modular surge protection system including:

a) a power distribution module to receive and distribute power from a source of line current, said power distribution module including:
   i) a housing;
   ii) a means of suppressing line current surges connected between the hot or live and earth or neutral conductors of said line current;
   iii) a female portion of a quick connect means formed on one end of said housing; and
   iv) a female power transfer receptacle having at least a female ground receptor provided adjacent the female portion of said quick connect means;

b) at least one power supply module removably connectable to said power transfer receptacle to supply power to electrically operated equipment through at least one power supply receptacle provided thereon, and to supply surge protection to said electrically operated equipment through said surge protection provided in said power distribution module, each power supply module including:
   i) a housing having a female portion of a quick connect means provided on one end thereof; said female portion of said quick connect means connectable to a male portion of a quick connect means;
   ii) a female power transfer receptacle provided adjacent said female portion of said quick connect means;
   iii) a male portion of a quick connect means formed at the other end of said housing; and
   iv) a male power transfer connector provided adjacent said male portion of said quick connect means; and c) a surge protection module including:
   i) a housing, said housing including a male portion of a quick connect means formed at one end thereof, and a female portion of a quick connect means formed at the other end of said housing;
   ii) a printed circuit board mounted within said housing;
   iii) a connecting means to connect a device or line being protected to ground, said connecting means mounted to said printed circuit board;
   iv) a female power transfer receptacle having at least a female ground receptor provided adjacent said female portion of said quick connect means, said female ground receptor mounted to said printed circuit board and electrically connected to said connecting means; and
   v) a male power transfer connector having at least a male ground connector provided adjacent said male portion of said quick connect means, said male ground connector mounted to said printed circuit board and electrically connected to said connecting means.

14. A combination surge protection module including, in combination:

a) a housing, said housing including a male portion of a quick connect means formed at one end thereof;

b) a printed circuit board mounted within said housing;

c) a plurality of connecting means to connect various devices or lines being protected to said module, said connecting means mounted to said printed circuit board;

d) a male power transfer connector having live, neutral and ground male connectors provided adjacent said male portion of said quick connect means;

e) a female portion of a quick connect means formed at the other end of said housing from said male portion of said quick connect means; and f) a female power transfer receptacle having live, neutral and ground receptors provided adjacent said female portion of said quick connect means.

15. The combination surge protection module defined in claim 14, and further including:

a) the ground receptor mounted to said printed circuit board and electrically connected to said various connecting means; and b) the male ground connector mounted to said printed circuit board and electrically connected to said various connecting means.

* * * * *